United States Patent [19]

Kawabata et al.

[11] Patent Number: 5,052,281

[45] Date of Patent: Oct. 1, 1991

[54] INTERNAL COMBUSTION ENGINE PISTON WITH TOP-LAND CIRCUMFERENTIAL PROJECTION ARRANGEMENT

[75] Inventors: Yasuhiro Kawabata, Anjo; Soichi Hara, Toyota; Shirou Machida, Okazaki; Hiroshi Kageyama, Toyota, all of Japan

[73] Assignee: Aisin Seiki Kabushiki Kaisha, Japan

[21] Appl. No.: 499,893

[22] Filed: Mar. 27, 1990

[30] Foreign Application Priority Data

Apr. 11, 1989 [JP] Japan ..... 1-91126

[51] Int. Cl.[5] ..... F02F 3/02; F02F 3/12; F02F 3/28

[52] U.S. Cl. ..... 92/192; 92/223

[58] Field of Search ..... 92/192, 209, 223; 123/193 P

[56] References Cited

U.S. PATENT DOCUMENTS

| | | | |
|---|---|---|---|
| 1,360,498 | 11/1920 | Chandlee | 92/192 X |
| 2,344,416 | 3/1944 | Scheibe | 92/192 |
| 2,845,917 | 8/1958 | Laubender | 92/209 X |

FOREIGN PATENT DOCUMENTS

| | | | |
|---|---|---|---|
| 2446870 | 4/1976 | Fed. Rep. of Germany | 123/193 P |
| 3022457 | 1/1982 | Fed. Rep. of Germany | 123/193 P |
| 2333961 | 7/1977 | France | 123/193 P |
| 355616 | 1/1938 | Italy | 92/192 |
| 262352 | 10/1989 | Japan | 123/193 P |
| 628049 | 8/1949 | United Kingdom | 92/209 |

*Primary Examiner*—Edward K. Look
*Assistant Examiner*—George Kapsalas
*Attorney, Agent, or Firm*—Banner, Birch, McKie & Beckett

[57] ABSTRACT

A piston installed into a cylinder of an engine includes annular projections formed in axially spaced relation on a top land facing a cylinder inner wall and having a saw-toothed cross-section in which the external diameter of the projections are such that, when cold, that adjacent the lower end of the top land is greater than that adjacent the upper end thereof. Thereby the effective clearance between the top land face and the cylinder inner wall is reduced. This causes a reduction in the hydrocarbon content of the incompletely consumed combustion gas, and prevents the temperature from rising in the top ring groove and thus prevents the wearing of the groove.

9 Claims, 1 Drawing Sheet

INTERNAL COMBUSTION ENGINE PISTON WITH TOP-LAND CIRCUMFERENTIAL PROJECTION ARRANGEMENT

BACKGROUND OF THE INVENTION

1. Field of the Invention

The present invention disclosed and claimed herein relates to an improved piston used in the engine of a motor vehicle.

2. Description of the Prior Art

Japanese Patent Publication No. 59-25868 shows a piston, which on its top land has aluminium powder, 2-sulfer-molybdenum, epoxy resin, and other component mixed in a certain ratio, and applied in a thickness greater than 30 μm. The form of the piston is shaped to correspond to the form of the cylinder as the engine operates. Consequently, the hydrocarbon content of the combustion gas is reduced, and a rise in temperature of the ring-groove is prevented.

However, the above-mentioned materials are very expensive, and furthermore the application of these materials to pistons is expensive because a piston must be coated many times with the materials to obtain the desired thickness. Thus, the working line required to apply these materials to a piston is excessively long. In addition, the epoxy-resin contemplated for use sometimes breaks off and interferes with the cylinder face.

Further, the thermal expansion coefficient of aluminum, which is a main material of the piston, is about double that of cast steel which is a material of the cylinder block. Thus, the top land of the piston expands more than the piston ring land part as a result of the combustion temperature. Therefore, the clearance between the cylindrical surface of the top land and that of the cylinder is normally designed to be from 0.4 mm to 0.6 mm, so that the top land does not slide heavily on the inner wall of the cylinder during engine operation. But, in order to reduce the hydrocarbon (HC) content of the exhaust gas, a reduction in the clearance provided between the surfaces of the piston and the cylinder is needed, and in providing the same the eccentricity of the cylinder hole, the profile between the skirt shoulder and the skirt end, and the overall profile of the piston must be considered. Also, in the assembly of the cylinder head, transmission, exhaust manifold and engine manifold to the cylinder block thermal deformation of the respective cylinder bores due to the unequal cooling of each must be taken into account. Therefore, although the most suitable diameter of the top land of the respective pistons may be different, in practice it is not practical to permit this so that a compromised, suitable, uniform top land diameter must be used.

SUMMARY OF THE INVENTION

It is, therefore, a primary object of the present invention to provide a piston to obviate the above-mentioned drawbacks of the prior art.

In order to accomplish the object, a piston adapted for insertion into a cylinder of an engine comprises a top land facing the inner cylinder wall, the top land having a series of annular projections formed thereon, that, when the piston is initially installed in the cylinder have the projections contacting the cylinder wall at the lower end of the top land and being concentrically spaced from the cylinder wall at the upper end thereof.

BRIEF DESCRIPTION OF THE DRAWINGS

The above and other objects, features and advantages of the present invention will become more apparent and more readily appreciated from the following detailed description of preferred exemplary embodiments of the present invention, taken in connection with the accompanying drawings, in which.

DETAILED DESCRIPTION OF THE PREFERRED EMBODIMENT

Figure 1:
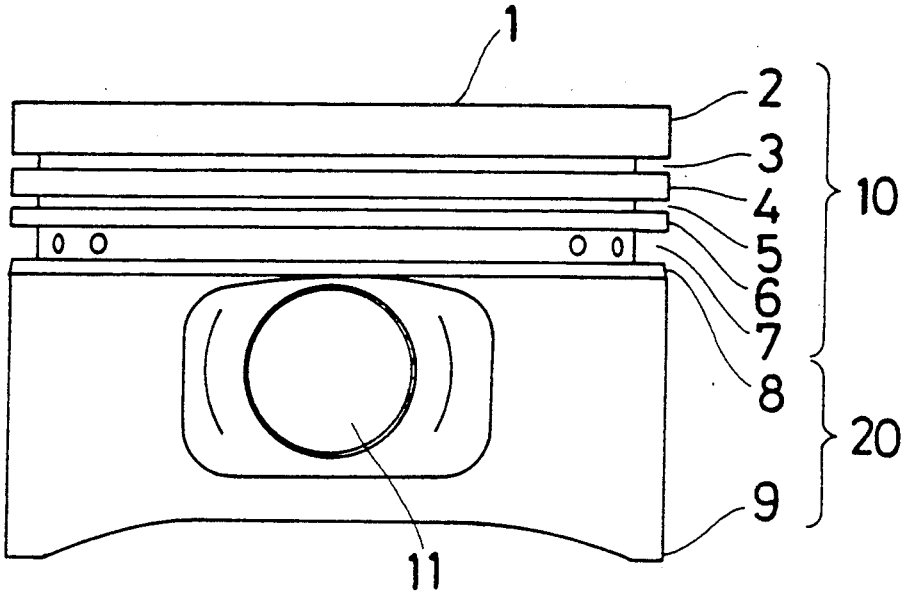
FIG. 1 shows a front view of a piston according to the present invention.
Figure 2:
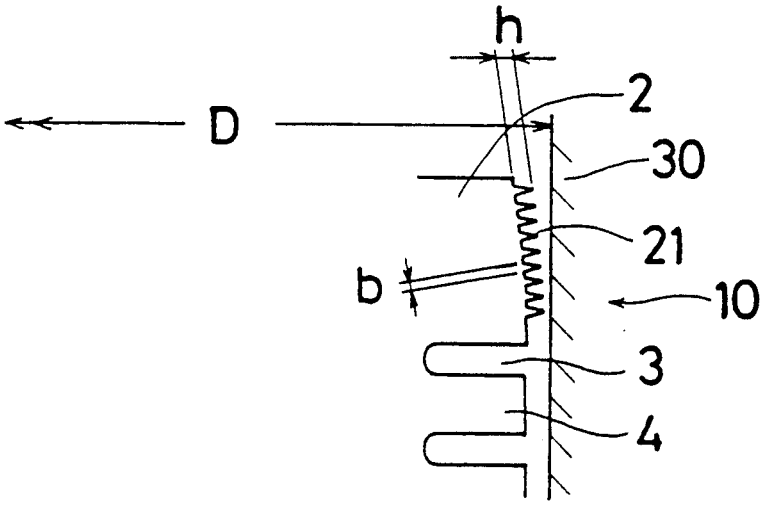
FIG. 2 shows an enlarged view of a piston in FIG. 1.

In FIGS. 1 and 2, a piston 1 is configured for insertion into a cylinder 30 of an engine, and comprises a land part 10 and a skirt part 20. A hole 11 for a pin to connect the piston to a crank shaft is formed between the land part 10 and the skirt part 20. On the land part 10, a top ring groove 3, a second ring groove 5, and an oil ring groove 7 are formed, and thereby a top land 2, a second land 4 and a third land 6 are defined intermediate the respective grooves. Reference numeral 9 indicates a skirt end. On the top land 2, annular projections 21, as shown in FIG. 2, are formed.

The outer diameter of the top land 2 at the base of annular projections 21, adjacent the top of ring groove 3, is designed to closely approximate the inner diameter of the cylinder 30, being only 0.4 mm–0.5 mm smaller than it. The outer diameter of the top land at the base of the annular projection 21 of the top face (crown part) is designed to be smaller than that adjacent the top ring groove 3, because the face of the top land has a large thermal expansion capacity. The outer diameter of the annular projection 21 adjacent the top ring groove 3 is nearly equal to the inner diameter of the cylinder 30. The height-to-width ratio of the projection 21 is set to be 2:1 to 5:1 and the width is set to be 0.1 mm–0.3 mm.

When the engine is started and the piston undergoes radial expansion, the tips of the projections 21 slide on the inner face of the cylinder 30 and are caused to erode rapidly, thereby to adapt to the cylinder face. Thus, the best gap for each of the cylinders is obtained. To obviate damage or jamming between the piston and the cylinder, the circumferential surface of the top land 2 can be coated by ethylene tetra fluoride, 2-sulfer molybdenum, or some other low friction material.

The reduction in clearance between the outer face of the top land and the inner wall of the cylinder causes a reduction in the hydrocarbon content of any incomplete combustion gas. Because this design prevents the combustion flame from extending into the part of the piston head containing the top ring, an undue temperature increase of the top ring groove is prevented and wear to the groove is reduced. Therefore, the reduction in hydrocarbon level in the exhaust gas operates to increase the output power and the fuel efficiency of the engine.

Obviously, numerous modifications and variations of the present invention are possible in light of the above teachings. It is therefore to be understood that within the scope of the appended claims, the invention may be practiced otherwise than as specifically described herein.

What is claimed is:

1. A piston adapted for insertion into a cylinder of a motor vehicle engine having an inner wall, said piston comprising a plurality of axially spaced lands including a top land at the upper end thereof adapted to face said cylinder inner wall, said top land being formed with a plurality of axially spaced, annular projections which, when cold, have external dimensions permitting the projection adjacent the lower end of said top land to substantially contact said cylinder inner wall with the projection adjacent the upper end of said top land being concentrically spaced from said cylinder inner wall.

2. A piston according to claim 1 in which said annular projections are integrally formed on said top land.

3. A piston according to claim 2 in which said annular projections are integrally formed on said top land.

4. A piston according to claim 3 in which said piston is formed substantially of aluminum.

5. A piston according to claim 2 in which said projection adjacent the lower end of said top land is formed with a height-to-width of base ratio in the range of from 2:1 to 5:1.

6. A piston according to claim 5 in which the width of base of said projection adjacent the lower end of said top land is in a range of from 0.1 mm. to 0.3 mm.

7. A piston according to claim 6 in which the external diameter of said projection adjacent the lower end of said top land is no greater than 0.4 mm. to 0.5 mm. smaller than the diameter of said cylinder inner wall.

8. A piston according to any one of claims 1 to 7 in which said projection adjacent the upper end of said top land had an external dimension causing said projection, when said engine is heated, to engage said cylinder inner wall.

9. A piston according to claim 8 in which said face of said top land is coated with a lubricating material.

* * * * *